US006089988A

United States Patent [19]

Winslow

[11] Patent Number: 6,089,988

[45] Date of Patent: Jul. 18, 2000

[54] PUTTER ALIGNMENT DEVICE AND METHOD OF USING SAME

[76] Inventor: Jeffrey S. Winslow, 10626 Aderman Ave., #12, San Diego, Calif. 92126

[21] Appl. No.: 09/020,453

[22] Filed: Feb. 9, 1998

[51] Int. Cl.[7] ..... A63B 69/36

[52] U.S. Cl. ..... 473/219; 473/240; 473/244; 473/409

[58] Field of Search ..... 473/240, 241, 473/226, 219, 227, 238, 239, 244, 231, 409, 267, 268, 236; D21/751

[56] References Cited

U.S. PATENT DOCUMENTS

| | | |
|---|---|---|
| D. 245,438 | 8/1977 | Thiel . |
| D. 245,439 | 8/1977 | Thiel . |
| 1,327,171 | 1/1920 | Ruggles . |
| 1,556,062 | 10/1925 | Baugh . |
| 1,939,414 | 12/1933 | Sametz . |
| 2,463,798 | 3/1949 | Paisley . |
| 3,198,525 | 8/1965 | Smith . |
| 3,727,919 | 4/1973 | Scott . |
| 4,053,160 | 10/1977 | Salata . |
| 4,079,520 | 3/1978 | Davis . |
| 4,116,448 | 9/1978 | Crowe . |
| 4,601,472 | 7/1986 | O'Flanagan . |
| 4,712,798 | 12/1987 | Preato . |
| 4,720,110 | 1/1988 | Hurst . |
| 4,722,528 | 2/1988 | Tsao . |
| 4,789,158 | 12/1988 | Chiesa . |
| 4,844,468 | 7/1989 | Lee . |
| 4,953,866 | 9/1990 | Bang . |
| 5,071,129 | 12/1991 | Wilson . |
| 5,195,749 | 3/1993 | Ugarte . |
| 5,509,657 | 4/1996 | Guthry . |
| 5,640,777 | 6/1997 | Densberger . |

*Primary Examiner*—Sebastiano Passaniti
*Attorney, Agent, or Firm*—Higgs, Fletcher & Mackup; Bernard L. Kleinke

[57] ABSTRACT

A putter alignment device is disclosed and includes a mounting frame for engaging a putter and for aligning the device relative to the putter face. A mirror frame having a mirror supported thereby is coupled pivotally to the mounting frame for aligning the putter relative to a target. A securing arrangement is adapted to engage the mounting frame at a portion thereof, extend behind the putter, and engage another portion of the mounting frame to attach removably the putter alignment device on the putter. Inventive sight members facilitate positioning of the eyes of the golfer relative to the target line as a part of the alignment method.

18 Claims, 1 Drawing Sheet

PUTTER ALIGNMENT DEVICE AND METHOD OF USING SAME

CROSS-REFERENCE TO RELATED APPLICATIONS

Not Applicable.

STATEMENT REGARDING FEDERALLY SPONSORED RESEARCH OR DEVELOPMENT

Not Applicable.

REFERENCE TO A "MICROFICHE APPENDIX"

Not Applicable.

BACKGROUND OF THE INVENTION

1. Technical Field

The present invention relates in general to a putter alignment device and a novel method of using it. The invention more particularly relates to a putter alignment device which attaches quickly and easily to a putter for facilitating the improvement of putting skills in accordance with a novel method.

2. Background Art

Many types of putter alignment aids were known for improving a putting game of a golfer, including the putter aids disclosed in the following U.S. Pat, Nos.: 1,327,171; 1,556,062; 2,463,798; 3,198,525; 3,727,919; 4,053,160; 4,079,520; 4,116,448; 4,601,472; 4,712,798; 4,720,110; 4,722,528; 4,789,158; 4,844,468; 4,953,866; 5,071,129; 5,195,749; 5,509,657; 5,640,777; Des. 245,438; and Des. 245,439.

For example, the following U.S. patents disclosed putter aids that attached to the shaft of a putter to help align the position of the putter to a position substantially normal to a path from the golf ball to a target such as a hole or pin: U.S. Pat. Nos. 3,198,525; 4,053,160; 4,079,520; 4,116,448; 4,789,158; 5,071,129; and 5,509,657. By securing the putter aid to the shaft, the golfer was able to look downwardly while in a putting stance to determine if the putter was properly positioned.

Although the disclosed putter aids enabled the golfer to adjust the putter to a desirable putting position before stroking a golf ball, the putter aids required a precise attachment to the shaft to ensure the putter aid was positioned properly relative to the club face of the putter. Where the putter aid was not properly positioned, the golfer was liable to obtain inconsistent and erroneous conditioning regarding the proper position of the putter.

Therefore, it would be highly desirable to have a new and improved putter alignment device which attaches quickly and easily to a putter, and which ensures the putter alignment device is properly positioned relative to the putter face. The putter alignment device can be used according to a novel method to permit the golfer to be conditioned for properly positioning the putter.

The following U.S. patents disclose putters having putting alignment devices integrated into the putter head: U.S. Pat. Nos. 1,327,171; 2,463,798; 4,712,798; 4,722,528; 4,944,468; 4,953,866; 5,195,749; 5,640,777; Des. 245,438; and Des. 245,439. By incorporating the putter alignment device into the putter head, the proper alignment of the putter alignment device relative to the putter face was substantially ensured without further adjustments of the putter alignment device.

While the disclosed putter aids did not require alignment of the putting aid relative to the putter face, and thus facilitated the conditioning of the golfer for a proper putting technique, the putter aids rendered the corresponding putters unsuitable for use during competitive play. In this regard, the use of such putter aids during a game of golf is not ordinarily permitted. Consequently, a putter having an integral putter aid would be utilized to practice putting, while another putter, without a putter aid, would be used to play a game of golf. As the physical properties of the putter with the putter aid were different from those of the putter without the putter aid, the conditioning received by the golfer using the putter and putter aid combination was not particularly relevant when a different putter is used during an actual game.

Therefore, it would also be highly desirable to have a new and improved putter alignment device which enables a golfer to use the same putter both for practicing desired putting strokes to condition the golfer, and for playing a game of golf.

Putter aids which can be removed from a putter to enable the putter to be used for both practicing and playing are disclosed in the following U.S. Pat. Nos.: 1,556,062; 3,727,919; 4,601,472; and 4,720,110. With the exception of U.S. Pat. No. 4,720,110, the patents disclosing removable putter aids require special mounting provisions incorporated into a putter to enable the putter aids to be secured to the putter while practicing putting strokes. As a result, the disclosed putter aids are not adapted for use with all types and styles of available putters.

The putter aid of U.S. Pat. No. 4,720,110 utilized a magnet to affix the putter aid to the putter face, thereby enabling the putter aid to be adaptable to many types and styles of putters. However, the magnetic attachment of the putter aid would be susceptible to readjustment during practice, and would require constant supervision to ensure proper alignment was maintained. Moreover, some modern putters have plastic inserts, and thus magnetic attachments would not be possible.

Therefore, it would also be highly desirable to have a new and improved putter alignment device that can be used with many types and styles of putters, and should stay in position during use. Such a putter alignment device should be relatively light in weight, and should be relatively inexpensive to manufacture.

All prior known devices employing mirrors for assisting a golfer to practice putting skills have fallen short of being satisfactory because they all lacked the ability to assist the golfer to align accurately and precisely the putter club face relative to the ball and the target. The main reason for this is that the golfer's eyes must be positioned directly above the target line and both eyes must be paralleled thereto to enable the golfer to obtain a correct visual perception of the target in the mirror. Thus, even though the conventional putting training device indicated that the club face was properly aligned with the ball and the target, if the eyes of the golfer are not positioned directly above the target line and parallel therewith the putter would not, in fact, be properly aligned. Thus, a subsequent swing would not necessarily achieve the desired result of the ball following the desired target line. This is because the initial impact of the putter head on the ball is not executed in the proper manner, even though the golfer may think or have the misconception that the putter is properly aligned.

Thus, it is critical to have a putter alignment device be able to help ensure that the eyes of the golfer be positioned directly and precisely above and parallel to the target line when aligning the putter with the ball and the target.

SUMMARY OF THE INVENTION

Therefore, the principal object of the present invention is to provide a new and improved putter alignment device which is quickly and easily attachable to a putter in a proper position relative to the putter face according to a novel method and apparatus.

A further object of the present invention is to provide such a new and improved putter alignment device, which enables the same putter to be used for both practice and for playing.

Another object of the present invention is to provide such a new and improved putter alignment device, which is adapted for use with many types and styles of putters, and which is relatively lightweight and inexpensive.

A still further object of the present invention is to provide such a new and improved putter alignment device, which enables the user to align more accurately and precisely the putter relative to the target line with the eyes of the golfer positioned properly relative to the target line.

Briefly, the above and future objects of the present invention are realized by providing a new and improved putter alignment device which attaches to many types and styles of putters quickly and easily. Such a putter alignment device enables the same putter to be used for both practice and for play, and is relatively inexpensive and light in weight. The new and improved putter alignment device of the present invention facilities a more accurate and precise alignment with the eyes of the golfer positioned accurately and precisely aligned directly over and parallel with the target line.

A putter alignment device is disclosed and includes a mounting frame for engaging a putter and for aligning the device relative to the putter face. A mirror frame having a mirror supported thereby is coupled pivotally to the mounting frame for aligning the putter relative to a target. A securing arrangement is adapted to engage the mounting frame at a portion thereof, extend behind the putter, and engage another portion of the mounting frame to attach removably the putter alignment device on the putter. Inventive sight members facilitate positioning of the eyes of the golfer relative to the target line as a part of the alignment method.

BRIEF DESCRIPTION OF THE DRAWINGS

The above mentioned and other objects and features of this invention and the manner of attaining them will become apparent, and the invention itself will be best understood by reference to the following description of the embodiment of the invention in conjunction with the accompanying drawings, wherein.

BEST MODE FOR CARRYING OUT THE INVENTION

Figure 1:
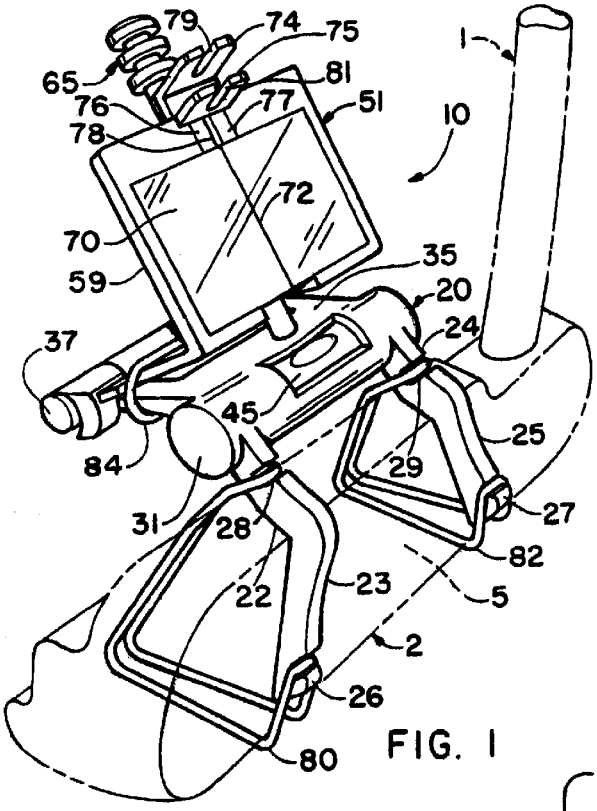
FIG. 1 is a pictorial view of a putter alignment device, which is constructed in accordance with the present invention, and which is illustrated as being mounted on a putter.
Figure 2:
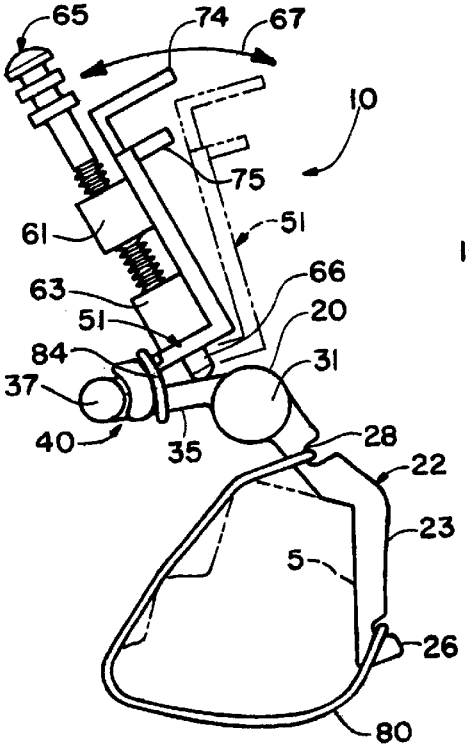
FIG. 2 is a side elevated view of the putter alignment device of FIG. 1, illustrating an adjustment of the device relative to the putter face.
Figure 3:
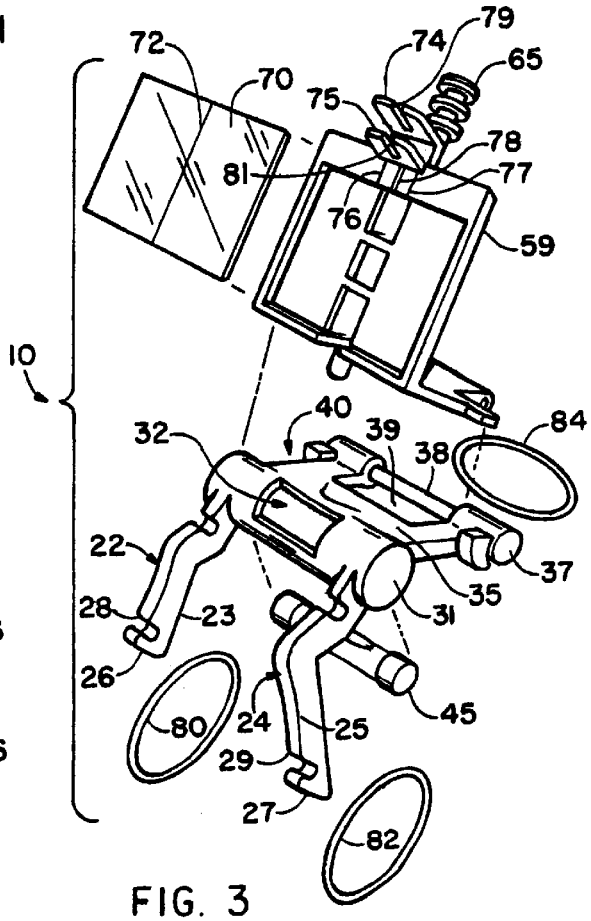
FIG. 3 is an exploded pictorial view of the putter alignment device of FIG. 1.

Referring now to the drawings, and more particularly to FIGS. 1–3 thereof, there is shown a putter alignment aid or device 10. The light weight device 10 is adapted to be mounted removably to a putter 1 having a putter head 2 with an associated putter face 5 (FIG. 2) for facilitating the proper alignment of the putter head 2 by a user (not shown) relative to a target (not shown). When used in accordance with the method of the present invention, the device 10 enables the user to be precisely and accurately "conditioned" during repeated practice for continually reproducing a proper putting stroke. The device 10 can easily be removed from the putter 1 so that the same putter can be used during the play of a game.

The device 10 includes a mounting frame assembly 20 generally indicated at for engaging the head 2 and for helping to secure the device 10 to the head 2 in a proper alignment relative to the face 5. Disposed within the mounting frame assembly 20 is a level indicating device 45 to indicate a heel/toe position of the head 2 when the mounting frame assembly 20 is mounted thereon. An L-shaped mirror frame assembly generally indicated at 51 is coupled pivotally to the mounting frame assembly 20 and supports a mirror 70 for reflecting an image of the target to facilitate aligning the putter 1, and the face 5, in a proper alignment position relative to the target. A securing arrangement, including a pair of stretchable resilient bands 80 and 82, is coupled to the mounting frame assembly 20 and extends around the head 2 to secure the device 10 to the head 2 to enable the device 10 to be mounted to a variety of different types and kinds of putters due to the ability of the stretchable resilient bands to conform to the shape and configuration of the putter head.

The bands 80 and 82 enable the device 10 to be easily attached to the head 2 to facilitate the practice of aligning the putter I in the proper alignment position. The mounting frame assembly 20 is positioned on the head 2, directly in engagement with the face 5. Subsequently, the bands 80 and 82 are engaged with a portion of the mounting frame assembly 20, and are extended around the rear portion of the head, to be engaged with another portion of the mounting frame assembly 20 to enclose securely the head between the assembly and the bands 80 and 82. The bands 80 and 82 are preferably composed of elastometric material, such as rubber, and are in the form of an endless loop. It will become apparent to those skilled in the art that the bands may also be in the form of stretchable resilient strips (not shown), which are not endless loops.

The device 10 can be removed quickly and easily by disengaging the bands 80 and 82 from the mounting frame assembly 20. Once the device 10 is removed, the user may utilize the putter 1 for participating in a game of golf in compliance with the rules of the game.

The mounting frame assembly 20 and the mirror frame assembly 51 are preferably constructed from a lightweight thermoplastic material to reduce substantially the weight of the device 10. In this way, the "feel" of the putter 1 is not substantially adversely affected by the weight of the device 10. Thus, the weight of the putter 1 during putting practice is substantially the same as the weight of the putter 1 during a game of golf.

In use, the device 10 is secured to the putter head 2, and the user assumes a stance while holding the putter 1 to address a golf ball (not shown) for putting the ball toward the target along a target line. The heel/toe position of the putter head 2 is adjusted until the level indicating device 45 indicates the head 5 is substantially horizontal. The putter head 2 is rotated while in its level orientation until the reflected image of the target provided by the mirror frame assembly 51 is seen by the golfer, wherein the putter face 5 is substantially perpendicular to the target line.

To facilitate the proper stance of the user with the eyes of the golfer directly over the target line and parallel thereto, the device 10 helps the golfer position his or her head with both eyes directly over the target line in accordance with an inventive sighting technique as hereinafter described in greater detail, so that the viewing of an image of the target line in the mirror 20 is highly precise and accurate without misconceptions as compared to prior known devices. It will be understood by one skilled in the art that the sequence of steps described above is only indicative of one possible sequence for aligning the putter 1, and that other sequences of steps are possible to obtain satisfactory results.

Considering now the putter alignment device 10 in greater detail, the mounting frame assembly 20 includes a pair of spaced apart, C-shaped leg members 22 and 24 depending from a cylindrical housing 31. As best seen in FIG. 2, a pair of parallel, spaced apart face engaging distal end portions 23 and 25 of the respective leg members 22 and 24 are adapted to engage the face 5 in a substantially flush manner at opposite sides of the central sweet spot of the putter face 5 so that the sweet spot can contact the ball without the leg members 22 and 24 interfering therewith. Consequently, the device 10 is properly aligned to the face 5, and thus the direct connection to the face ensures that the device 10 will remain in precise alignment with the putter head in accordance with the present invention.

Hook members 26 and 27 of the distal end portions 23 and 25 cooperate with centrally disposed notch members 28 and 29 to engage and retain the bands 80 and 82 therebetween. The distal end portions 23 and 25 are spaced apart sufficiently to permit the "sweet spot" of the putter face 5 to be exposed when the device 10 is secured on the putter head 2. In this way, not only does the sweet spot remain unobscured by the device 10, but also the leg portions 23 and 25 serve as indicators for helping the golfer align the sweet spot with the ball. In this regard, the key portions 23 and 25 help define the sweet spot there between for the golfer.

The cylindrical housing 31 is substantially hollow, and includes a rear opening (not shown) to receive and retain the level indicating device 45 therein. A rectangular front opening 32 (FIG. 3) through the housing 31 enables the level device 45 to be observed by the user.

A substantially flat member 35 extends rearwardly from the housing 31, and includes a bi-furcated end portion having an integral hinge pin member 37 spaced apart from the housing 31. A central hinge pin portion 38 (FIG. 3) is adapted to cooperate with the mirror frame assembly 51 to permit the assembly 51 to pivot relative to the assembly 20. An opening 39 at the bi-furcated portion of the member 35 is disposed adjacent to the hinge portion 38, and a pair of spaced apart notches such as the notch generally indicated at 40 (FIG. 3) is disposed at the sides of the bifurcated member 35.

The mirror frame assembly 51 includes a hinge arrangement adapted to partially enclose the central hinge pin portion 38 at the opening 39. A stretchable resilient band 84, substantially similar to the bands 80 and 82, is disposed about the assembly 20 and the assembly 51 at the notches, such as the notch 40, to urge resiliently the pivoting of the assembly 51 toward the assembly 20.

In order to adjust pivotally the assemblies 51 and 20 relative to one another for adjusting the relative position of the mirror 70 relative to the face 5, and thus to adjust positionally the mirror 70 face angle of the head 2, internally threaded members 61 and 63 (FIG. 2) integrally connected to the rear side of the mirror support member 59 cooperate with a set or adjustment screw 65 to position angularly the mirror 70 against the force of the band 84 relative to the putter face 5 to accommodate the associated face angle of the face 5. In this regard, the face angle of a putter can vary from putter to putter to suit the user. Depending upon the characteristics of the user, a putter may have a standard face angle, a negative face angle or a positive face angle. By rotating the screw 65 in either a clockwise or counter-clockwise direction, the angular relationship of the assemblies 51 and 20 and thus the mirror 70, can be increased or decreased relative to the putter face 5 as indicated by arrow 67 (FIG. 2) to position the mirror 70 for the particular face angle of the putter 1. This face angle adjustment is an initial adjustment which can be made when first mounting the device 10 to a particular putter. The adjustment screw serves as an adjustable stop since its tip end 66 (FIG. 2) engages the flat member 35 to drive the assembly 51 toward and away from the assembly 20 against the force of the band 84.

The mirror frame assembly 51 further includes a rectangular mirror support member 59 adapted to receive the mirror 70 therein. The mirror 70 is preferably secured to the member 59 by an adhesive, or by other suitable means.

A pair of parallel spaced apart sight members 74 and 75 is disposed on the member 59 above the mirror 70, and is vertically aligned with a vertical center indicating line 72 disposed on the mirror 70. To align the putter face 5 to the proper alignment position, the user rotates the putter 1 about its shaft until the target image is in alignment with the center indicating line 72. By aligning the sight member 74 with the center indicating line 72, the user positions his or her eyes directly over the target line according to the desired putting stance.

For the purpose of facilitating the accurate sighting of the mirror 70 with both eyes of the golfer in proper alignment with the target line, the pair of generally vertically aligned and parallel spaced apart sight members 74 and 75 are disposed on the member 59 above the mirror 70. The sight members 74 and 75 are notched and are aligned with one another to cooperate with a head position indicating sight line 78 defined as a narrow linear spacing between a pair of spaced apart brightly colored indicia areas 76 and 77, to facilitate the alignment of the eyes of the golfer with the device 10 and its center sight line 72 on the mirror 70. The sight members 74 and 75 substantially reduce alignment errors relative to the sight line 72 to ensure the eyes of the user are both positioned directly over the target line.

The sight members 74 and 75 and the head position indicator line 78 enable the golfer to align properly his or her eyes directly over the target line by indicating to the golfer when the eyes are positioned improperly either forwardly or rearwardly relative to the ball, or outwardly or inwardly relative to the target line. The sight members 74 and 75 help indicate the forward or rearward positioning of the eyes (not shown), since the upper sight member 74 has a narrow vertical sighting notch 79 and has a substantially greater height than the lower sight member 75 having an aligned narrow vertical sighting notch 81. Thus, as best seen in FIG. 2, the user can position his or her eyes until the upper edges of the members 74 and 75 appear to be aligned with one another. In so doing, the eyes are precisely and accurately positioned directly over the target line with the forward eye positioned properly relative to the golf ball. The exact position of the forward eye relative to the ball is determined by the adjustment of the mirror 70 relative to the putter face 5 by means of the adjustment screw setting. This setting may vary, depending upon the preference of a given golfer.

Once the forward/rearward adjustment is so achieved, the inward and outward alignment is then adjusted by moving the head of the golfer positionally adjustable until neither indicia area 76 and 77 are viewed through the aligned narrow sighting notches 79 and 81. In this regard, if the golfer visualizes either one of the colored areas 76 and 77, he or she will adjust the position of the head either inwardly or outwardly until neither one of the areas 76 and 77 are visualized within the aligned notches 79 and 81.

The areas 76 and 77 may be of a brightly contrasting color, such as a fluorescent red, orange or yellow. In this manner, the color of the indicia area will contrast sharply with the other more neutral colors of the device 10 and the green color of the golf course grass reflected from the mirror 70.

By utilizing the sighting members 74 and 75 and the indicator line 78 in the manner as described, the golfer is ensured that his or her eyes are properly aligned with the mirror 70. Thus, when the golfer then visualizes the target and aligns the mirror sight line 72 with the target along the target line, there are no misconceptions in the mind of the golfer relative to the alignment of the putter face with the ball and the target line.

Figure 4:
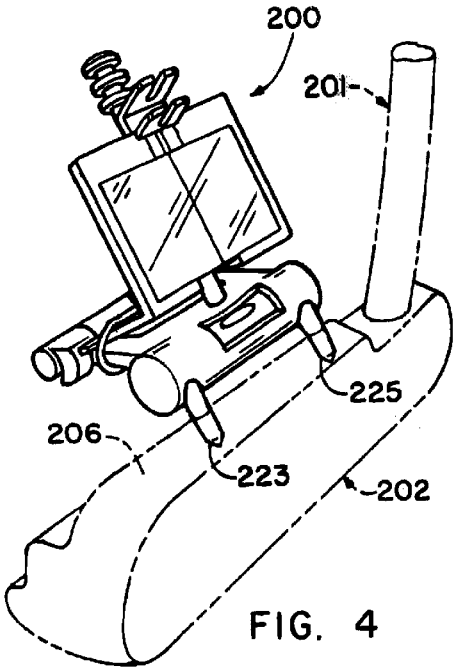
FIG. 4 is a pictorial view of another putter alignment device, which is also constructed in accordance with the present invention, which is illustrated as being mounted on a putter.

Referring now to FIG. 4 there is shown another putter alignment device 200 for aligning a putter 201, having putter head 202, in accordance with the present invention. The device 200 is substantially similar to the putter alignment device 10 (FIGS. 1–3), except the mounting technique for the mounting technique for the device 200 is somewhat different. The device 200 is to be received within a pair of spaced apart openings in a top surface 206 of the putter head 202. In this regard, the device 200 includes distal stab end portions 223 and 225 which are received securely and removably within the openings. Thus, the device 200 can be used to facilitate obtaining a proper alignment position relative to a target (not shown) during putting practice in the same manner as the device 10, and the device 200 can be removed from the putter head 202 to permit the putter 201 to be used to participate in a game of golf in compliance with the rules of golf.

The stub end portions 223 and 225 extend angularly from the device 200 and fit into complementary shaped holes in a friction fit manner.

While particular embodiments of the present invention have been disclosed, it is to be understood that various different modifications are possible and are contemplated within the true spirit and scope of the appended claims. There is no intention, therefore, of limitations to the exact abstract or disclosure herein presented.

What is claimed is:

1. A putter alignment device for use on a bead of a putter having a putter face with an associated face angle to facilitate a proper alignment of the putter by a user with a target along a target line, comprising:

a mounting frame adapted to be positioned on the putter head in accordance with the putter face angle;

reflective alignment means mounted on said frame for indicating the alignment of the putter face;

sight means disposed on said mirror frame for cooperating with said alignment means to enable the eyes of the user to be positioned over the target line in a forward and rearward orientation; and head position indicator means on said frame above said reflective means for helping to align the head of the user relative to the device in an inward and outward direction.

2. A putter alignment device according to claim 1, wherein said alignment means includes a center line indicator and sight means.

3. A putter alignment device according to claim 1 wherein said frame means includes a pair of spaced apart legs.

4. A putter alignment device according to claim 1, further including a level means for indicating a heel-toe position of the putter head.

5. A putter alignment device according to claim 1, further including a securing arrangement adapted to extend around the putter head and cooperate with said mounting frame for attaching removably said mounting frame to the putter head.

6. A putter alignment device according to claim 5, wherein said securing arrangement includes at least one elastic band.

7. A putter alignment device according to claim 1, wherein said mounting frame includes a pair of spaced apart legs adapted to engage the putter face to orient said reflective means relative to the putter face.

8. A putter alignment device according to claim 1, wherein said mounting frame includes a pair of spaced apart legs adapted to be received in the putter head.

9. A putter alignment device according to claim 1, wherein said sight means includes a pair of parallel spaced-apart sight members each having a narrow notch therein for enabling the golfer to sight said reflective means over the top edges thereof.

10. A putter alignment device according to claim 1, wherein said members have unequal heights.

11. A putter alignment device according to claim 1, wherein said head positioning indicator means includes a pair of spaced-apart indicia areas defining a head position indicator sight line therebetween.

12. A putter alignment device according to claim 1, wherein said reflective means includes a mirror frame having a mirror mounted therein, means for mounting said frame pivotally relative to said mounting frame, an adjustment arrangement connected to said mirror frame for adjusting the angular position of said mirror relative to said mounting frame, means for urging resiliently said mounting frame and said mirror frame toward one another, and an adjustable stop means for causing the frames to move toward and away from one another against the force of said means for urging resiliently.

13. A putter alignment device according to claim 1, wherein said mounting frame and said sight means are constructed from a thermoplastic material.

14. A putter alignment device according to claim 1, further including integral hinge means for coupling pivotally said reflective means and said mounting frame.

15. A method of positioning the eyes of a golfer directly over a target line for a putter, comprising:

aligning visually a pair of spaced sighting members;

visualizing the aligned sighting members with an indicator line on a reflective member;

wherein the eyes of a user are positioned directly over the target line for the putter;

wherein the sighting members have narrow notches therein and are of unequal height, said aligning including visualizing the two edges when they are aligned with one another to align the eye of the golfer with said reflective means.

16. A method of positioning the eyes of a golfer directly over a target line for a putter, comprising:

aligning visually a pair of spaced sighting members;

visualizing the aligned sighting, members with an indicator line on a reflective member;

wherein the eyes of a user are positioned directly over the target line for the putter;

using a level indicator, and adjusting a heel-toe position of the putter until said level indicator indicates the putter head is substantial horizontal.

17. A method of positioning the eyes of a golfer directly over a target line for a putter, comprising:

aligning visually a pair of spaced sighting members;

visualizing the aligned sighting members with an indicator line on a reflective member;

wherein the eyes of a user are positioned directly over the target line for the putter; and adjusting the angular position of the reflective device relative to the face angle of the putter head.

18. A method according to claim 17, further including engaging said mounting frame with an elastic band to removably secure said mounting frame to the putter head, adjusting the angular position of the reflective device relative to the face angle of the putter head.

* * * * *